US011847975B2

(12) United States Patent
Kim et al.

(10) Patent No.: US 11,847,975 B2
(45) Date of Patent: Dec. 19, 2023

(54) DATA DRIVER AND DISPLAY DEVICE INCLUDING THE SAME

(71) Applicant: LG DISPLAY CO., LTD., Seoul (KR)

(72) Inventors: Kyung Rok Kim, Paju-si (KR); Min Kim, Paju-si (KR); Hyuck Jun Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 18/050,988

(22) Filed: Oct. 29, 2022

(65) Prior Publication Data

US 2023/0206859 A1 Jun. 29, 2023

(30) Foreign Application Priority Data

Dec. 28, 2021 (KR) ..... 10-2021-0190365

(51) Int. Cl.
*G09G 3/3275* (2016.01)

(52) U.S. Cl.
CPC ... *G09G 3/3275* (2013.01); *G09G 2300/0452* (2013.01); *G09G 2310/027* (2013.01); *G09G 2310/0286* (2013.01); *G09G 2310/08* (2013.01); *G09G 2320/0242* (2013.01)

(58) Field of Classification Search
CPC ..... G09G 3/3275; G09G 2300/0452; G09G 2310/027; G09G 2310/0286; G09G 2310/08; G09G 2320/0242; G09G 5/00; G09G 2340/02; G09G 2340/0435; G09G 2340/06; G09G 3/2003
See application file for complete search history.

(56) References Cited

U.S. PATENT DOCUMENTS

| | | | | |
|---|---|---|---|---|
| 9,928,791 | B2 * | 3/2018 | Ahn | G09G 3/3607 |
| 10,325,541 | B2 * | 6/2019 | Hochman | G09G 3/2074 |
| 10,880,558 | B2 * | 12/2020 | Ström | H04N 9/68 |
| 11,302,237 | B2 * | 4/2022 | Kim | G09G 3/2003 |
| 11,335,276 | B2 * | 5/2022 | Lee | G09G 3/3406 |
| 11,705,065 | B2 * | 7/2023 | Lee | G09G 3/2003 345/694 |
| 2016/0071473 | A1 * | 3/2016 | Ahn | G09G 3/3655 345/88 |
| 2016/0180760 | A1 * | 6/2016 | Hochman | G09G 3/2003 345/694 |
| 2019/0238866 | A1 * | 8/2019 | Ström | H04N 19/186 |
| 2020/0365094 | A1 * | 11/2020 | Lee | G09G 3/3406 |
| 2021/0398472 | A1 * | 12/2021 | Kim | G09G 3/2003 |
| 2022/0208097 | A1 * | 6/2022 | Lee | G09G 3/3233 |
| 2023/0206859 | A1 * | 6/2023 | Kim | G09G 5/00 345/694 |

* cited by examiner

*Primary Examiner* — Michael J Jansen, II
(74) *Attorney, Agent, or Firm* — POLSINELLI PC

(57) ABSTRACT

A display device includes a display panel configured to display an image, a gate driver connected to gate lines of the display panel, and a data driver connected to data lines of the display panel, and the data driver provides duplicates of red, green and blue data signals, except for a white data signal, in a digital data signal having a 4:2:0 format externally input thereto, and converts the white data signal, the red, green and blue data signals, and the duplicated red, green and blue data signals, thereby outputting an analog data voltage having a 4:4:4 format.

8 Claims, 11 Drawing Sheets

FIG. 11

Input (4:2:0)

| | | | | | | | |
|---|---|---|---|---|---|---|---|
| $W_{11}$ | $R_{11}$ | $G_{11}$ | $B_{11}$ | $W_{12}$ | - | - | - |
| $W_{21}$ | - | - | - | $W_{22}$ | - | - | - |

Output (4:4:4)

| | | | | | | | |
|---|---|---|---|---|---|---|---|
| $W_{11}$ | $R_{11}$ | $G_{11}$ | $B_{11}$ | $W_{12}$ | $R_{11}$ | $G_{11}$ | $B_{11}$ |
| $W_{21}$ | $R_{11}$ | $G_{11}$ | $B_{11}$ | $W_{22}$ | $R_{11}$ | $G_{11}$ | $B_{11}$ |

DATA DRIVER AND DISPLAY DEVICE INCLUDING THE SAME

CROSS-REFERENCE TO RELATED APPLICATION

This application claims the priority of Korean Patent Application No. 10-2021-0190365 filed on Dec. 28, 2021, which is hereby incorporated by reference in its entirety.

BACKGROUND

Field of the Disclosure

The present disclosure relates to a data driver and a display device including the same.

Description of the Background

In accordance with development of information technology, the market for display devices as a medium interconnecting users and information is expanding. As such, use of display devices such as a light emitting display (LED) device, a quantum dot display (QDD) device, a liquid crystal display (LCD) device and the like is increasing.

The above-mentioned display devices include a display panel including subpixels, a driver configured to output a drive signal for driving the display panel, and a power supply configured to generate electric power to be supplied to the display panel or the driver.

When drive signals, for example, scan signals and data signals, are supplied to subpixels formed at a display panel in a display device as mentioned above, selected ones of the subpixels transmit light or directly emit light and, as such, the display device may display an image.

SUMMARY

Accordingly, the present disclosure is directed to a data driver and a display device including the same that substantially obviate one or more problems due to limitations and disadvantages of the related art.

More specifically, the present disclosure is to provide a data driver and a display device including the same which are capable of not only realizing an image based on a standard type data signal having a 4:4:4 format, but also minimizing picture quality degradation caused by a chromaticity component lost during realization of an image based on a custom type data signal having a 4:2:0 format.

Additional advantages and features of the disclosure will be set forth in part in the description which follows and in part will become apparent to those having ordinary skill in the art upon examination of the following or may be learned from practice of the disclosure. Other advantages of the disclosure may be realized and attained by the structure particularly pointed out in the written description and claims hereof as well as the appended drawings.

To achieve these and other advantages and in accordance with the purpose of the disclosure, as embodied and broadly described herein, a display device includes a display panel configured to display an image, a gate driver connected to gate lines of the display panel, and a data driver connected to data lines of the display panel, wherein the data driver provides duplicates of red, green and blue data signals, except for a white data signal, in a digital data signal having a 4:2:0 format externally input thereto, and converts the white data signal, the red, green and blue data signals, and the duplicated red, green and blue data signals, thereby outputting an analog data voltage having a 4:4:4 format.

The data driver may include a data selector configured to perform an operation of selectively duplicating the red, green and blue data signals, except for the white data signal, in accordance with a format of a data signal externally input thereto.

The data selector may perform a data signal duplication operation when a digital data signal having a 4:2:0 format is externally input, and may not perform a data signal duplication operation when a digital data signal having a 4:4:4 format is externally input.

The data driver may further include a first latch configured to sample the red, white, green and blue data signals and the duplicated red, green and blue data signals output through the data selector on a one-line basis, a second latch configured to sample the white data signal output through the first latch on a one-line basis, and a third latch configured to hold the red, green and blue data signal and the duplicated red, green and blue data signals output through the first latch, and the white data signal output through the second latch.

The second latch may sample only the white data signal under control of the data selector when a digital data signal having a 4:2:0 format is externally input.

The data driver may output a white data voltage for one horizontal time, and may output red, green and blue data voltages for two horizontal times.

The red, white, green and blue data voltages may be charged in red, white, green and blue subpixels of the display panel during falling edges of gate signals applied to the gate lines, respectively.

The display panel may include at least one white subpixel configured to store a white data voltage during a falling edge of a first gate signal applied through a first gate line, at least one red subpixel, at least one green subpixel and at least one blue subpixel respectively configured to store red, green and blue data voltages during a falling edge of a second gate signal applied through a second gate line disposed next to the first gate line, and the at least one white subpixel, the at least one red subpixel, the at least one green subpixel and the at least one blue subpixel are disposed on the same horizontal line.

In another aspect of the present disclosure, a data driver includes a data selector configured to perform an operation of selectively duplicating red, green and blue data signals, except for a white data signal, in accordance with a format of a data signal externally input thereto, a first latch configured to sample the red, white green and blue data signals and the duplicated red, green and blue data signals output through the data selector on a one-line basis, a second latch configured to sample the white data signal output through the first latch on a one-line basis, a third latch configured to hold the red, green and blue data signal and the duplicated red, green and blue data signals output through the first latch, and the white data signal output through the second latch, and an output unit configured to convert the data signals output through the third latch into data voltages having an analog form and to output the data voltages.

The data selector may perform a data signal duplication operation when a digital data signal having a 4:2:0 format is externally input, and may not perform a data signal duplication operation when a digital data signal having a 4:4:4 format is externally input.

In accordance with the exemplary aspects of the present disclosure, there are effects of not only realizing an image based on a standard type data signal having a 4:4:4 format, but also minimizing a picture quality degradation problem caused by a chromaticity component lost during realization of an image based on a custom type data signal having a 4:2:0 format. In addition, there is an effect of minimizing restrictions such as picture quality degradation, etc., when a data signal compressed in a chroma subsampling manner is implemented in an ultra-high resolution environment of a UHD grade or higher.

BRIEF DESCRIPTION OF THE DRAWINGS

The accompanying drawings, which are included to provide a further understanding of the disclosure and are incorporated in and constitute a part of this application, illustrate aspect(s) of the disclosure and along with the description serve to explain the principle of the disclosure.

In the drawings:

FIGS. 10 and 11 are diagrams explaining a compensation concept for a data signal according to an exemplary aspect of the present disclosure;

DETAILED DESCRIPTION

A display device according to an exemplary aspect of the present disclosure may be implemented as a television, an image player, a personal computer (PC), a home theater, an automobile electric device, a smartphone, etc., without being limited thereto. The display device according to the exemplary aspect of the present disclosure may be implemented as a light emitting display (LED) device, a quantum dot display (QDD) device, a liquid crystal display (LCD) device, etc. However, the following description will be given in conjunction with, for example, a light emitting display device configured to directly emit light based on an inorganic light emitting diode or an organic light emitting diode, for convenience of description.

Figure 1:
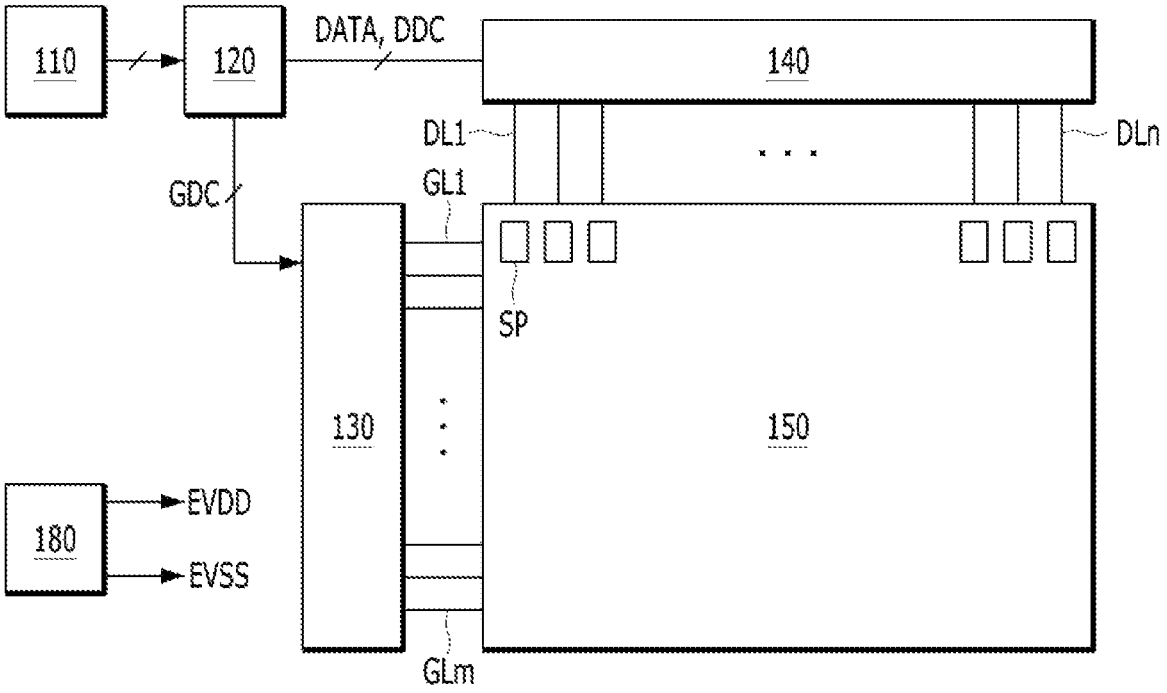
FIG. 1 is a block diagram schematically showing a light emitting display device.
Figure 2:
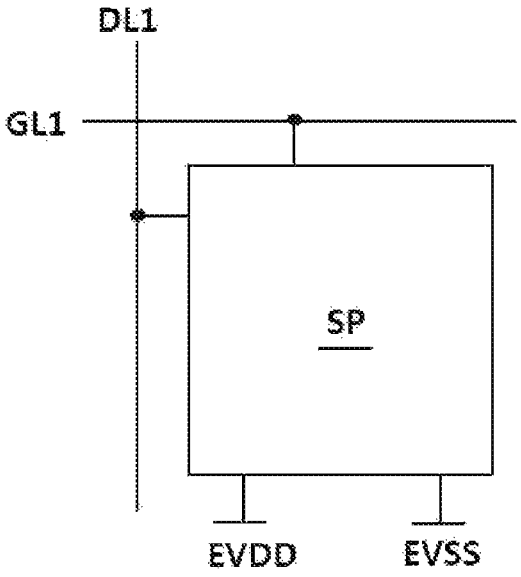
FIG. 2 is a diagram schematically showing a subpixel shown in FIG. 1.

FIG. 1 is a block diagram schematically showing a light emitting display device. FIG. 2 is a diagram schematically showing a subpixel shown in FIG. 1.

As shown in FIGS. 1 and 2, the light emitting display device may include an image supplier 110, a timing controller 120, a gate driver 130, a data driver 140, a display panel 150, a power supply 180, etc.

The image supplier 110 (a set or a host system) may output various driving signals together with an image data signal supplied from an exterior thereof or an image data signal stored in an internal memory thereof. The image supplier 110 may supply a data signal and various driving signals to the timing controller 120.

The timing controller 120 may output a gate timing control signal GDC for control of an operation timing of the gate driver 130, a data timing control signal DDC for control of an operation timing of the data driver 140, various synchronization signals (a vertical synchronization signal Vsync and a horizontal synchronization signal Hsync), etc. The timing controller 120 may supply a data signal DATA supplied from the image supplier 110 together with the data timing signal DDC to the data driver 140. The timing controller 120 may take the form of an integrated circuit (IC) and, as such, may be mounted on a printed circuit board, without being limited thereto.

The gate driver 130 may output a gate signal (or a gate voltage) in response to the gate timing control signal GDC, etc. supplied from the timing controller 120. The gate driver 130 may supply a gate signal to the subpixels included in the display panel 150 through gate lines GL1 to GLm. The gate driver 130 may take the form of an IC or may be directly formed on the display panel 150 in a gate-in-panel manner, without being limited thereto.

The data driver 140 may sample and latch a data signal DATA in response to the data timing control signal DDC, etc. supplied from the timing controller 120, may convert the resultant data signal, which has a digital form, into a data voltage having an analog form, based on a gamma reference voltage, and may output the data voltage. The data driver 140 may supply the data voltage to the subpixels included in the display panel 150 through data lines DL1 to DLn. The data driver 140 may take the form of an IC and, as such, may be mounted on the display panel 150 or may be mounted on a printed circuit board, without being limited thereto.

The power supply 180 may generate first power of a high-level voltage and second power of a low-level voltage based on an external input voltage supplied from an exterior thereof, and may output the first power and the second power through a first power line EVDD and a second power line EVSS. The power supply 180 may generate and output not only the first power and the second power, but also a voltage (for example, a gate voltage including a gate-high voltage and a gate-low voltage) required for driving of the gate driver 130, a voltage (a drain voltage and a drain voltage including a half drain voltage) required for driving of the data driver 140, etc.

The display panel 150 may display an image, corresponding to the driving signal including the gate signal and the data voltage, the first power, the second power, etc. The subpixels of the display panel 150 may directly emit light. The display panel 150 may be fabricated based on a substrate having stiffness or ductility, such as glass, silicon, polyimide or the like. The subpixels, which emit light, may be constituted by red, green and blue subpixels or red, green, blue and white subpixels.

For example, one subpixel SP may include a pixel circuit connected to a first data line DL1, a first gate line GL1, a first power line EVDD and a second power line EVSS while including a switching transistor, a driving transistor, a capacitor, an organic light emitting diode, etc. The subpixel SP, which is used in the light emitting display device, has a complex circuit configuration because the subpixel SP directly emits light. Furthermore, a compensation circuit configured to compensate for degradation of not only the organic light emitting diode, which emits light, but also the driving transistor configured to supply, to the organic light emitting diode, driving current required for driving of the organic light emitting diode, etc. is also diverse. For convenience of illustration, however, the subpixel SP is simply shown in the form of a block.

Meanwhile, in the above description, the timing controller 120, the gate driver 130, the data driver 140, etc. have been described as having individual configurations, respectively. However, one or more of the timing controller 120, the gate driver 130 and the data driver 140 may be integrated into one IC in accordance with an implementation type of the light emitting display device.

Figure 3:
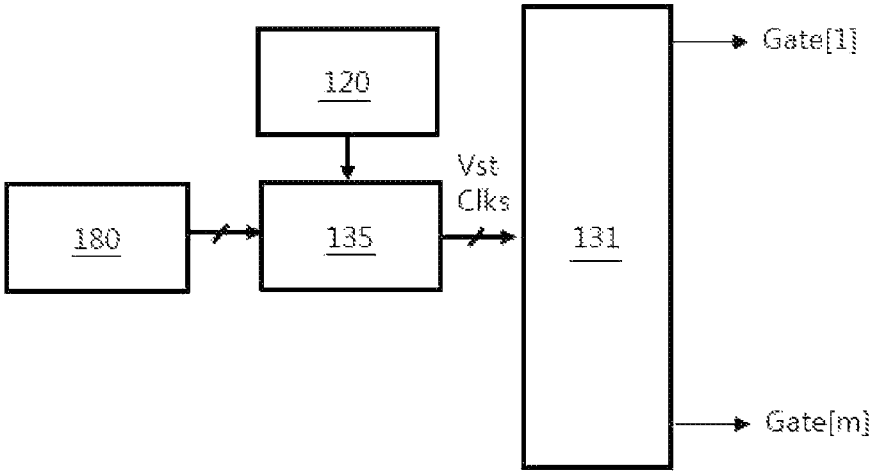
FIGS. 3 and 4 are views explaining a configuration of a gate-in-panel type gate driver.
Figure 4:
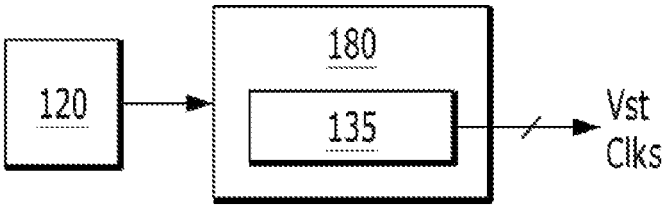
Figure 5:
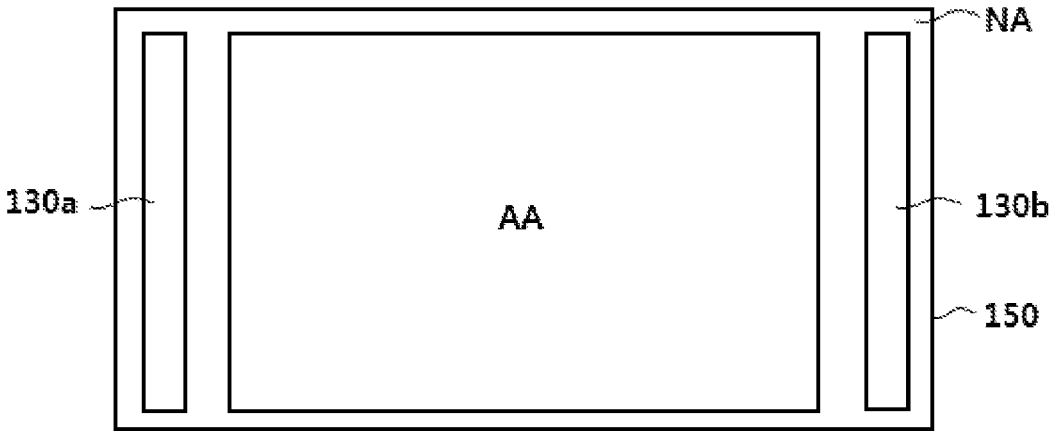
FIG. 5 is a view showing a disposition example of a gate-in-panel type gate driver.

FIGS. 3 and 4 are views explaining a configuration of a gate-in-panel type gate driver. FIG. 5 is a view showing a disposition example of a gate-in-panel type gate driver.

As shown in FIG. 3, the gate-in-panel type gate driver may include a shift register 131 and a level shifter 135. The level shifter 135 may generate clock signals Clks, a start signal Vst, etc. based on signals and voltages output from a timing controller 120 and a power supply 180. The clock signals Clks may be generated under the condition that the clock signals Clks have J different phases (J being an integer of 2 or greater), such as 2-phase, 4-phase, 8-phase, etc.

The shift register 131 may operate based on the signals Clks and Vst, etc. output from the level shifter 135, and may output gate signals Gate[1] to Gate[m] capable of turning on or off transistors formed at a display panel. The shift register 131 may be formed on the display panel in a gate-in-panel manner in the form of a thin film.

As shown in FIGS. 3 and 4, the level shifter 135 may be independently formed in the form of an IC or may be internally included in the power supply 180, differently from the shift register 131. However, this configuration is only illustrative, and the exemplary aspects of the present disclosure are not limited thereto.

As shown in FIG. 5, gate drivers 130*a* and 130*b*, which output gate signals in a gate-in-panel type gate driver, may be disposed in a non-display area NA of a display panel 150. Although the gate drivers 130*a* and 130*b* have been illustrated as being disposed in left and right non-display areas NA of the display panel 150, the gate drivers 130*a* and 130*b* may be disposed in upper and lower non-display areas NA of the display panel 150 or may be disposed in a display area AA of the display panel 150.

Figure 6:
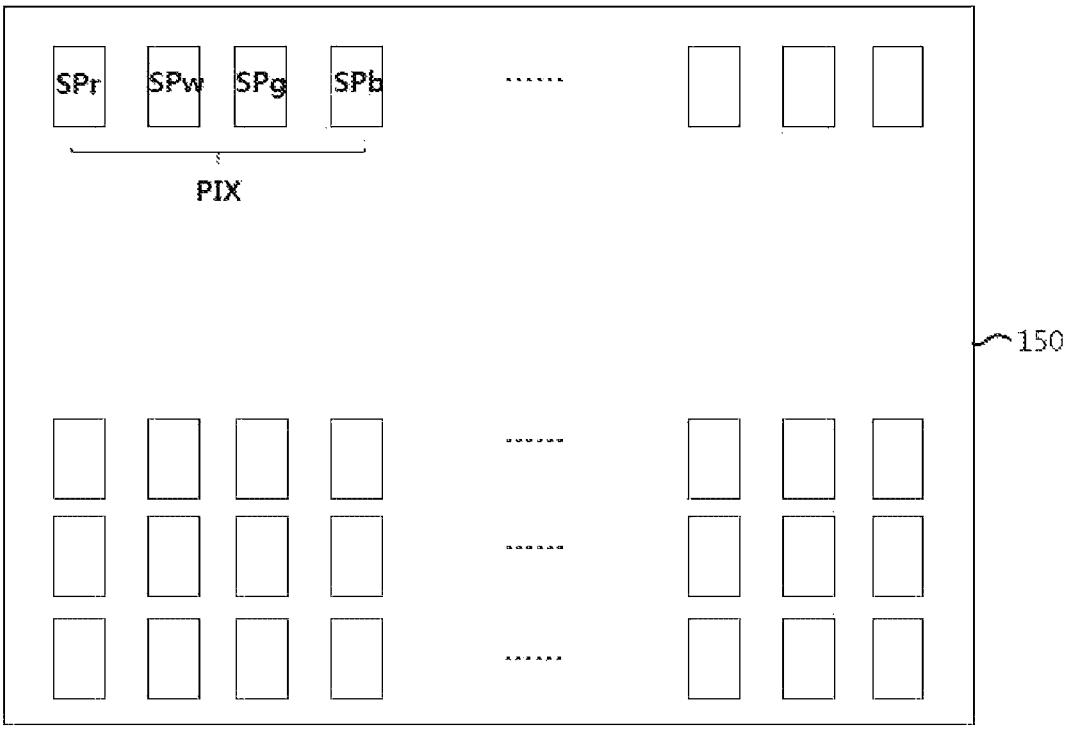
FIGS. 6 and 7 are diagrams explaining pixels disposed in a display panel and a disposition example of the pixels.
Figure 7:
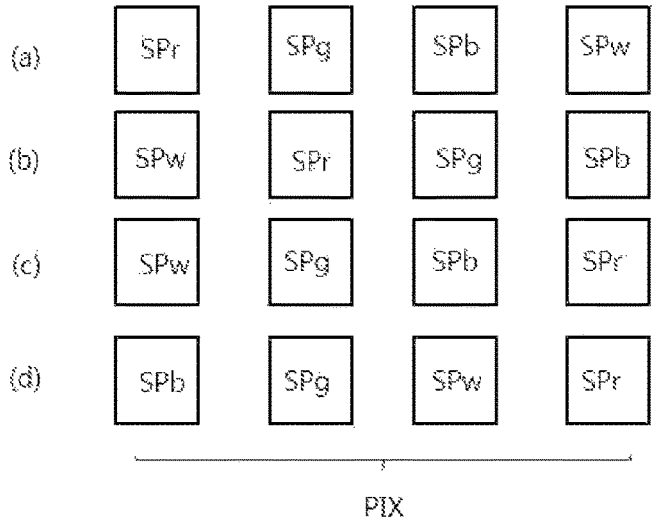

FIGS. 6 and 7 are diagrams explaining pixels disposed in a display panel of a light emitting display device and a disposition example of the pixels.

As shown in FIG. 6, the light emitting display device may display an image based on a display panel 150 including pixels PIX disposed in the form of a matrix. One pixel PIX disposed in the display panel 150 may include a red subpixel SPr, a white subpixel SPw, a green subpixel SPg, and a blue subpixel SPb.

As shown in FIGS. 7(*a*) to 7(*d*), the disposition order of the red subpixel SPr, the green subpixel SPg, the blue subpixel SPb and the white subpixel SPw may be varied in accordance with an implementation type of the display panel.

Figure 8:
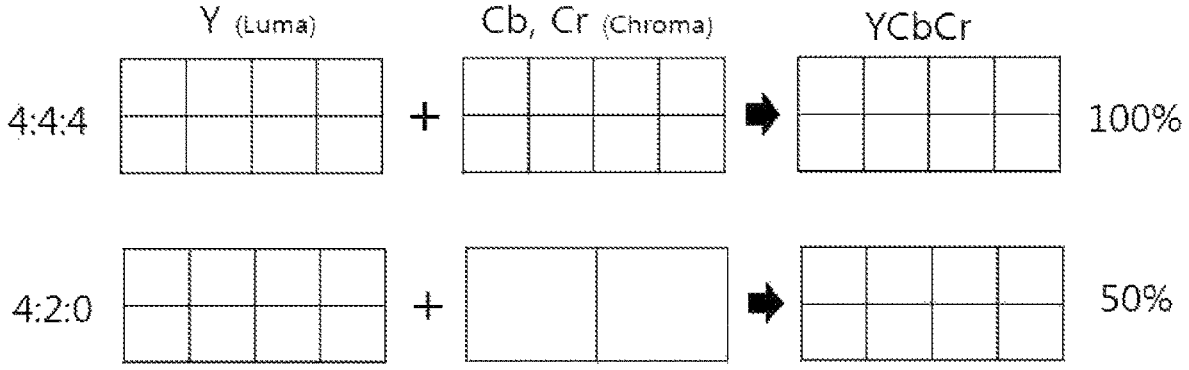
FIG. 8 is a diagram showing formats of data signals and a data volume difference between the data signals in accordance with the formats of the data signals.
Figure 9:
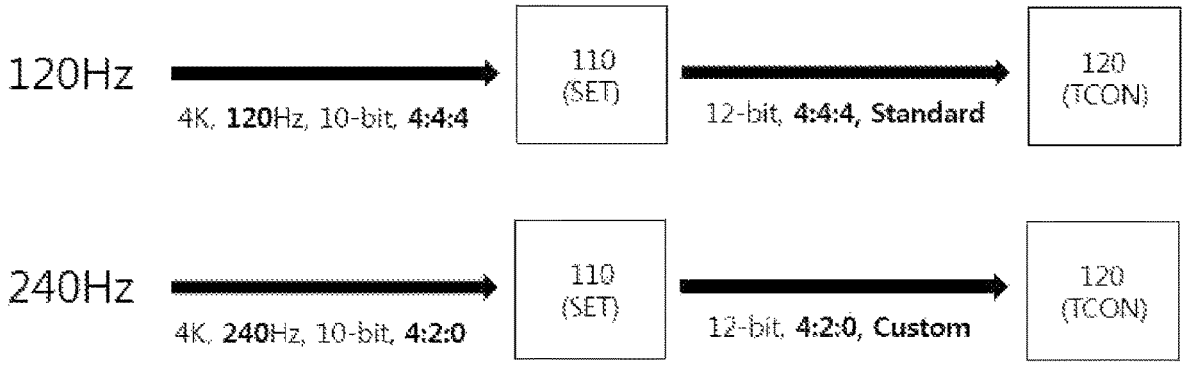
FIG. 9 is a diagram explaining driving conditions according to formats of input data signals.

FIG. 8 is a diagram showing formats of data signals and a data volume difference between the data signals in accordance with the formats of the data signals. FIG. 9 is a diagram explaining driving conditions according to formats of input data signals.

As shown in FIG. 8, a data signal YCbCr for display of an image may be constituted by a luminance component Y (Luma) and chromaticity components Cb and Cr (Chroma). A data signal YCbCr of an original image produced through image production may have a 4:4:4 format.

In broadcast and video media, however, in order to achieve a reduction in data transmission capacity, some signal components may be discarded from a data signal YCbCr of original video such that the data signal YCbCr is formatted into a 4:2:0 format, and the resultant data signal may then be transmitted. A method of reducing only chromaticity components Cb and Cr (Chroma) while still maintaining a luminance component Y (Luma), as described above, is referred to as "chroma subsampling".

FIG. 8 illustrates an example of chroma subsampling in which a data signal YCbCr of an original image is compression-sampled from a 4:4:4 format into a 4:2:0 (or 4:2:2) format such that the ratio of a brightness value Y, a first hue value Cb and a second hue value Cr included in the data signal YCbCr is varied from 4:4:4 to 4:2:0 (or 4:2:2). As seen from FIG. 8, although the data volume of the data signal YCbCr, which has a 4:4:4 format, is 100%, the data volume of the data signal YCbCr may be reduced to 50% when the data signal YCbCr is down-sampled to a 4:2:0 format. Since a reduction in data processing capacity for an image may be achieved through down-sampling of the image, many advantages may be provided in association with parts handling signals at both an image transmission side and an image reception side.

As shown in FIG. 9, a data signal may be input to an image supplier 110 (SET) at 4K resolution, a 120 Hz driving frequency, a 10-bit data bit and 4:4:4 format, or at 4K resolution, a 240 Hz driving frequency, a 10-bit data bit and 4:4:4 format. As can be seen by referring to data signals output from the image supplier 110 to a timing controller 120 (TCON), although the data signals of the 4:4:4 format and the 4:2:0 format are output under the condition that both the data signals have 12-bit data bits, the data signal of the 4:4:4 format may be recognized as a standard, whereas the data signal of the 4:2:0 format may be recognized as a custom.

As such, a display device such as a light emitting display device or the like may render an image based on the 4:4:4 format, the 4:2:0 format, etc. However, when a data signal compressed in a chroma subsampling manner is implemented in an ultra-high resolution environment of a UHD grade or higher, a picture quality degradation problem of blurring of a portion of an image or a character or the like caused by influence of a lost chromaticity component may occur. Therefore, it is necessary to eliminate such a problem.

Figure 10:
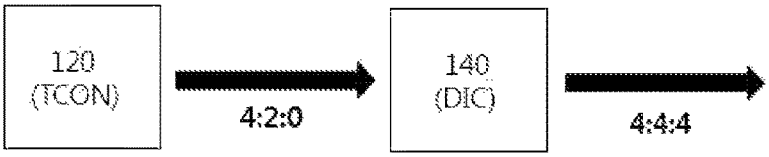

FIGS. 10 and 11 are diagrams explaining a compensation concept for a data signal according to an exemplary aspect of the present disclosure.

As shown in FIGS. 10 and 11, in accordance with the exemplary aspect of the present disclosure, when a data signal compressed in a 4:2:0 format in a chroma subsampling manner is input to a timing controller 120 from an exterior thereof, the timing controller 120 may perform image processing or the like for the input data signal, and may output the resultant data signal to a data driver 140. In addition, the data driver 140 may compensate the data signal compressed in the 4:2:0 format and, as such, may produce a data signal in 4:4:4 format and may then output the data signal. The data driver 140 may compensate a data signal for a lost chromaticity component in a digital manner, and may then output the resultant data signal.

Figure 12:
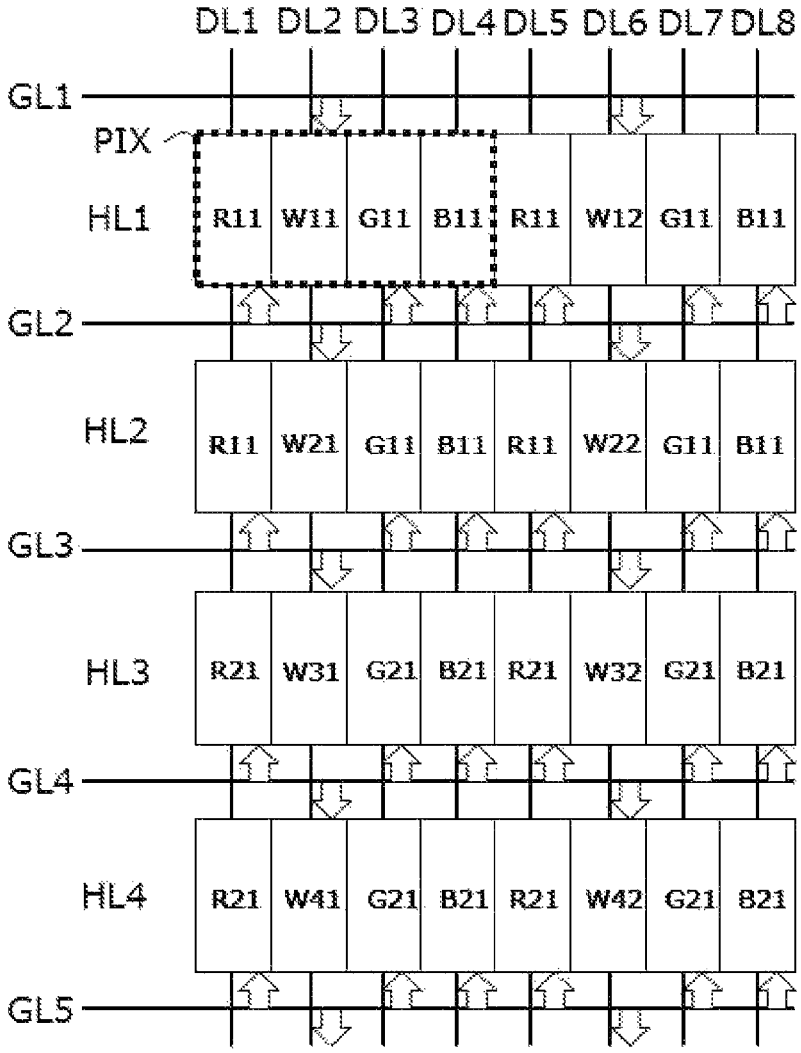
FIG. 12 is a diagram explaining a display panel according to an exemplary aspect of the present disclosure.
Figure 13:
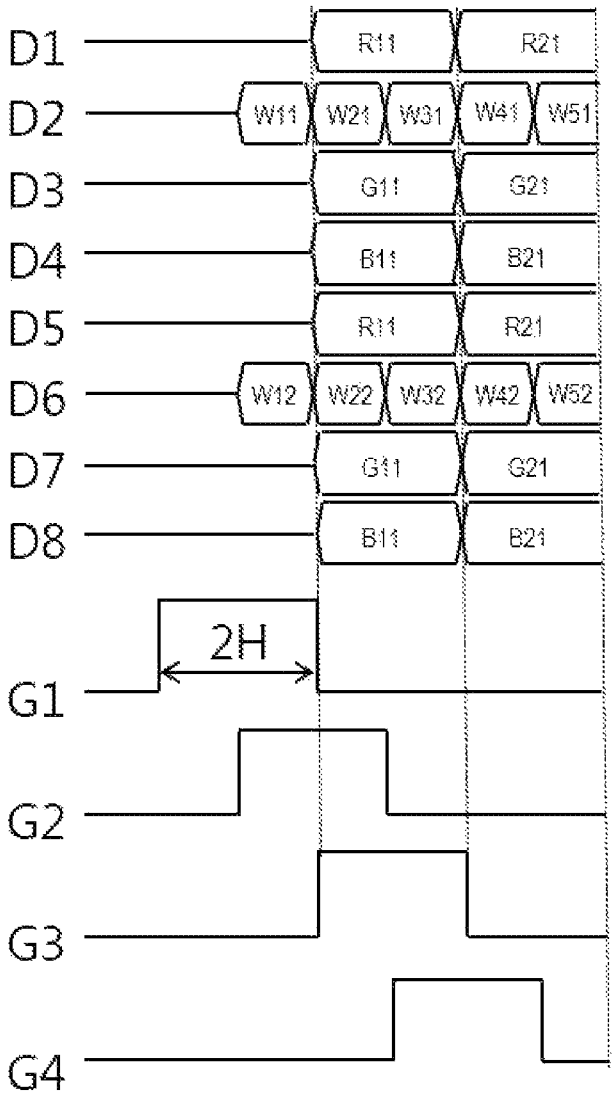
FIG. 13 is a diagram explaining a method for applying a data voltage and a gate signal in accordance with an exemplary aspect of the present disclosure.

FIG. 12 is a diagram explaining a display panel according to an exemplary aspect of the present disclosure. FIG. 13 is a diagram explaining a method for applying a data voltage and a gate signal in accordance with an exemplary aspect of the present disclosure.

As shown in FIG. 12, pixels included in the display panel according to the exemplary aspect of the present disclosure may have a disposition relationship and a connection relationship identical to those of a pixel PIX, which will be described hereinafter.

The display panel may include the pixel PIX which is disposed in the order of a red subpixel R11, a white subpixel W11, a green subpixel Gil and a blue subpixel B11 in a horizontal direction. A first gate line GL1 may be disposed at an upper end of the pixel PIX, to extend in the horizontal direction, and a second gate line GL2 may be disposed at a lower end of the pixel PIX, to extend in the horizontal direction. First to fourth data lines DL1 to DL4 may be disposed to extend in a vertical direction intersecting the first gate line GL1 and the second gate line GL2.

The red subpixel R11 may be connected to the first data line DL1 and the second gate line GL2. The red subpixel R11 may emit light based on a first data voltage applied thereto through the first data line DL1, in response to a second gate signal applied thereto through the second gate line GL2.

The white subpixel W11 may be connected to the second data line DL2 and the first gate line GL1. The white subpixel W11 may emit light based on a second data voltage applied thereto through the second data line DL2, in response to a first gate signal applied thereto through the first gate line GL1.

The green subpixel Gil may be connected to the third data line DL3 and the second gate line GL2. The green subpixel Gil may emit light based on a third data voltage applied thereto through the third data line DL3, in response to the second gate signal applied thereto through the second gate line GL2.

The blue subpixel B11 may be connected to the fourth data line DL4 and the second gate line GL2. The blue subpixel B11 may emit light based on a fourth data voltage applied thereto through the fourth data line DL4, in response to a second gate signal applied thereto through the second gate line GL2.

As shown in FIGS. 12 and 13, output formats of data voltages D1, D3, D4, D5, D7 and D8 output from the first data line DL1, the third data line DL3, the fourth data line DL4, a fifth data line DL5, a seventh data line DL7 and an eighth data line DL8 may be different from those of data voltages D2 and D6 output from the second data line DL2 and a sixth data line DL6.

Each of the first gate signal G1 applied through the first gate line GL1, the second gate signal G2 applied through the second gate line GL2, a third gate signal G3 applied through a third gate line GL3 and a fourth gate signal G4 applied through a fourth gate line GL4 may be applied at a logic-high level (a turn-on voltage of a transistor included in the pixel) for a time of 2H. In addition, these gate signals G1 to G4 may be applied such that adjacent ones of the gate signals G1 to G4 overlap each other for a time of 1H.

A description associated with application of the data voltages D1 to D8 and the gate signals G1 to G4 shown in FIG. 13 to the display panel shown in FIG. 12 will be additionally given hereinafter.

In a first horizontal line HL1 of FIG. 12, an eleventh white data voltage W11 of the white subpixel connected to the second data line DL2 and a twelfth white data voltage W12 of the white subpixel connected to the sixth data line DL6 may be charged during a falling edge of the first gate signal G1 shown in FIG. 13. The eleventh white data voltage W11 and the twelfth white data voltage W12 charged in the first horizontal line HL1 may be produced based on a white data signal included in a data signal having a 4:2:0 format.

In the first horizontal line HL1 of FIG. 12, an eleventh red data voltage R11 of the red subpixel connected to the first data line DL1, an eleventh green data voltage Gil of the green subpixel connected to the third data line DL3, and an eleventh blue data voltage B11 of the blue subpixel connected to the fourth data line DL4 may be charged during a falling edge of the second gate signal G2 shown in FIG. 13. The eleventh red data voltage R11, the eleventh green data voltage Gil and the eleventh blue data voltage B11 respectively charged in the first data line DL1, the third data line DL3 and the fourth data line DL4 in the first horizontal line HL1 may be produced based on red, green and blue data signals included in the data signal having the 4:2:0 format.

In the first horizontal line HL1, an eleventh red data voltage R11 of the red subpixel connected to the fifth data line DL5, an eleventh green data voltage Gil of the green subpixel connected to the seventh data line DL7, and an eleventh blue data voltage B11 of the blue subpixel connected to the eighth data line DL8 may be charged during the falling edge of the second gate signal G2 shown in FIG. 13. The eleventh red data voltage R11, the eleventh green data voltage Gil and the eleventh blue data voltage B11 respectively charged in the fifth data line DL5, the seventh data line DL7 and the eighth data line DL8 in the first horizontal line HL1 may be duplicates (duplicated data signals) of the red, green and blue data signals supplied to the first data line DL1, the third data line DL3 and the fourth data line DL4.

In a second horizontal line HL2 of FIG. 12, a twenty-first white data voltage W21 of the white subpixel connected to the second data line DL2 and a twenty-second white data voltage W22 of the white subpixel connected to the sixth data line DL6 may be charged during the falling edge of the second gate signal G2 shown in FIG. 13. The twenty-first white data voltage W21 and the twenty-second white data voltage W22 charged in the second horizontal line HL2 may be those input next to the white data signals for production of the eleventh white data voltage W11 and the twelfth white data voltage W12 of the first horizontal line HL1.

In the second horizontal line HL2 of FIG. 12, the eleventh red data voltage R11 of the red subpixel connected to the first data line DL1, the eleventh green data voltage Gil of the green subpixel connected to the third data line DL3, and the eleventh blue data voltage B11 of the blue subpixel connected to the fourth data line DL4 may be charged during a falling edge of the third gate signal G3 shown in FIG. 13. The eleventh red data voltage R11, the eleventh green data voltage Gil and the eleventh blue data voltage B11 respectively charged in the first data line DL1, the third data line DL3 and the fourth data line DL4 in the second horizontal line HL2 may be duplicates (duplicated data signals) of the red, green and blue data signals supplied to the first data line DL1, the third data line DL3 and the fourth data line DL4 of the first horizontal line HL1.

In the second horizontal line HL2, the eleventh red data voltage R11 of the red subpixel connected to the fifth data line DL5, the eleventh green data voltage Gil of the green subpixel connected to the seventh data line DL7, and the eleventh blue data voltage B11 of the blue subpixel connected to the eighth data line DL8 may be charged during the falling edge of the third gate signal G3 shown in FIG. 13. The eleventh red data voltage R11, the eleventh green data voltage Gil and the eleventh blue data voltage B11 respectively charged in the fifth data line DL5, the seventh data line DL7 and the eighth data line DL8 in the second horizontal line HL2 may be duplicates (duplicated data signals) of the red, green and blue data signals supplied to the first data line DL1, the third data line DL3 and the fourth data line DL4.

Referring to the above description, it can be seen that the white data voltage (for example, W11 and W12) is not produced based on a duplicated data signal and, as such, may be output during one horizontal time (H) for which a gate signal for one line (for example, G1) is applied, whereas the red, green and blue data voltages R11, Gil and B11 are produced based on duplicated data signals and, as such, may be output during two horizontal times (H) for which gate signals for two lines (for example, G2 and G3) are applied. That is, data signals produced through duplication may be output on a multi-line (at least two lines) basis with respect to horizontal lines.

Figure 14:
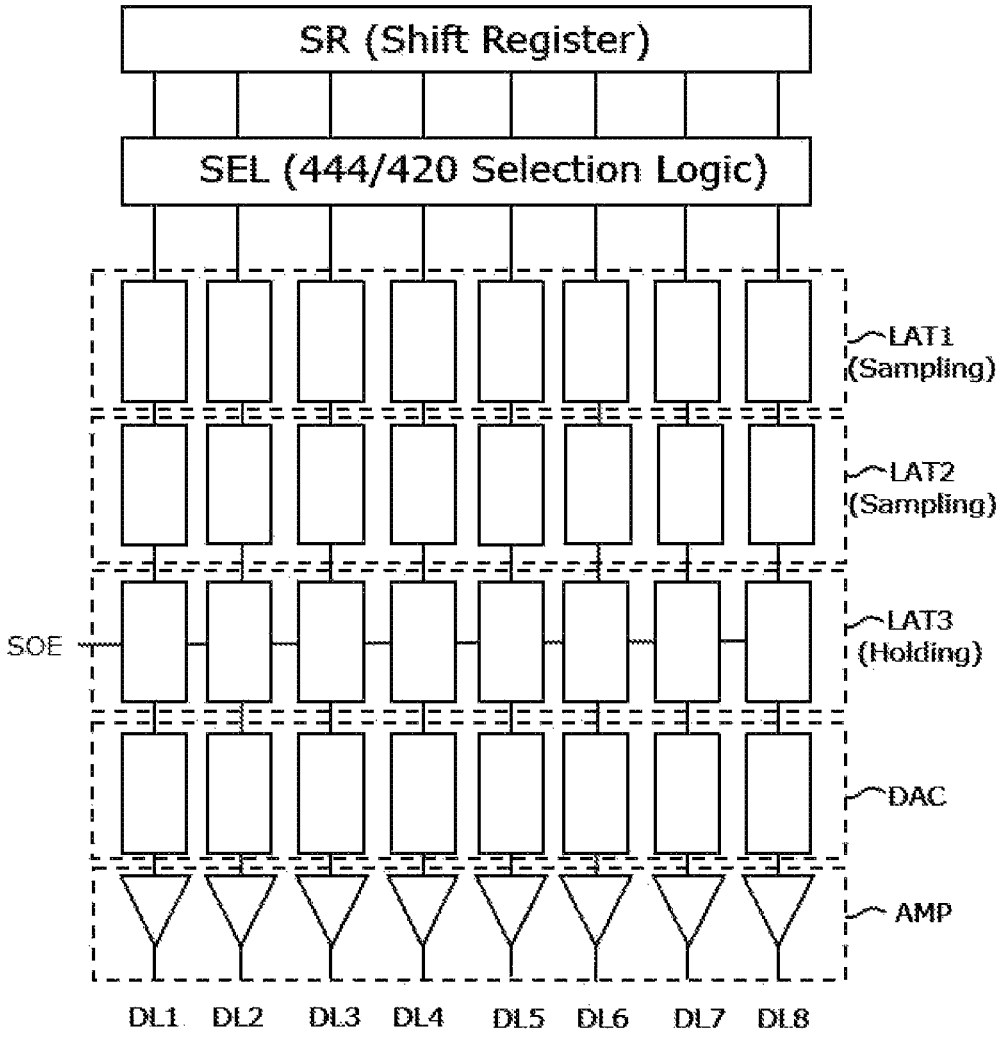
FIG. 14 is a diagram briefly explaining a configuration of a data driver according to an exemplary aspect of the present disclosure.
Figure 15:
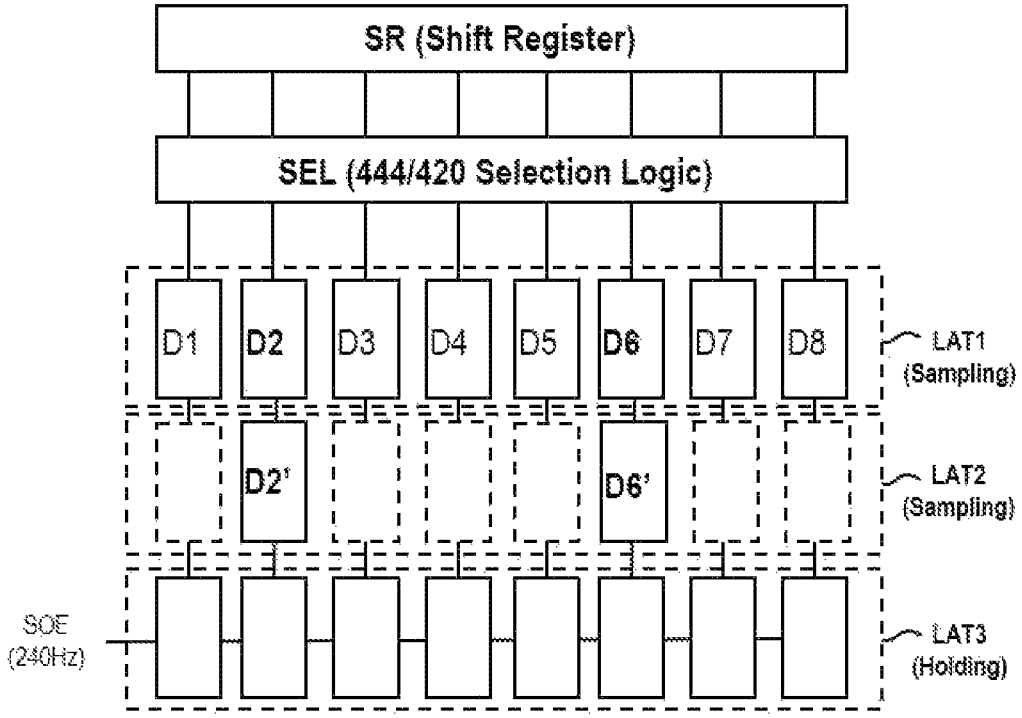
FIGS. 15 to 17 are diagrams explaining a procedure associated with duplication of data signals based on some of data signals stored in latches in accordance with an exemplary aspect of the present disclosure.
Figure 16:
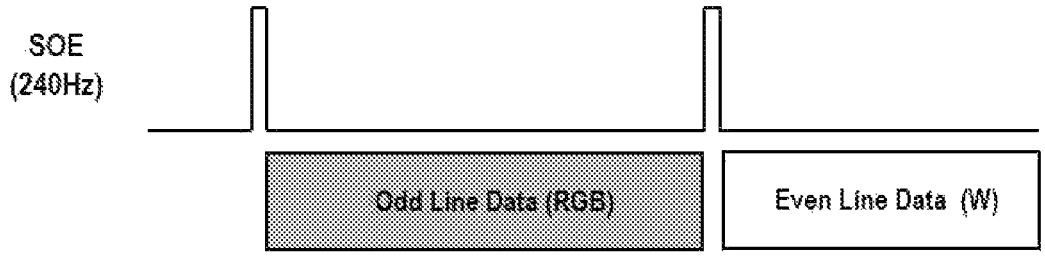
Figure 17:
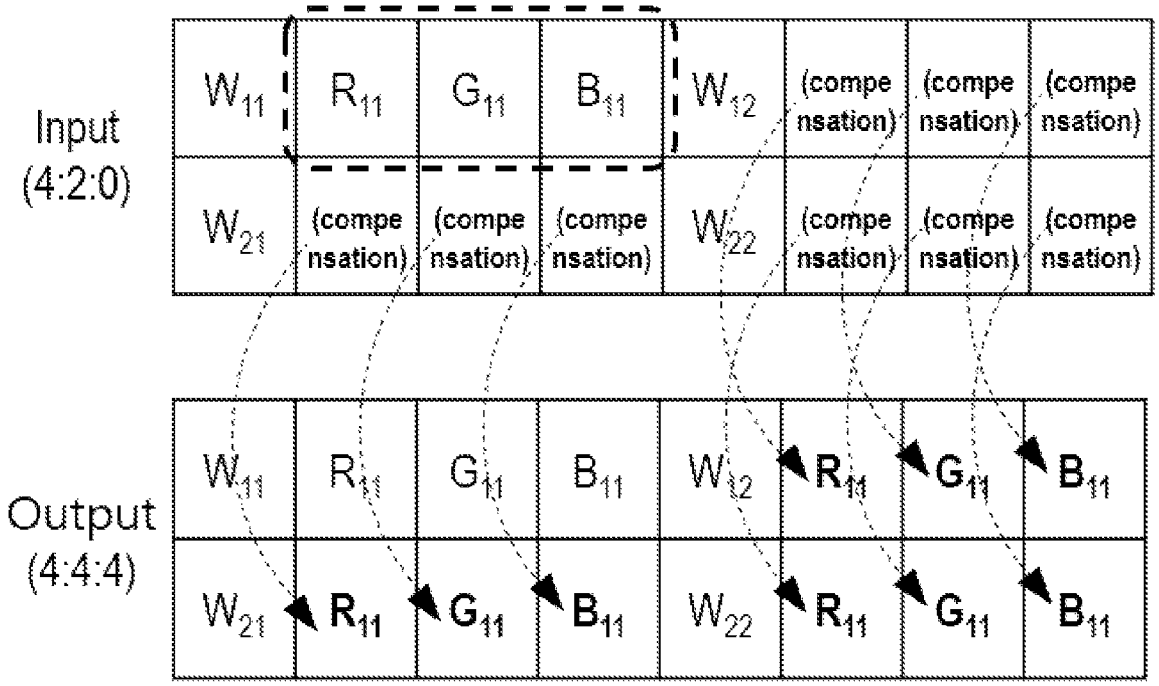

FIG. 14 is a diagram briefly explaining a configuration of a data driver according to an exemplary aspect of the present disclosure. FIGS. 15 to 17 are diagrams explaining a procedure associated with duplication of data signals based on some of data signals stored in latches in accordance with an exemplary aspect of the present disclosure.

As shown in FIG. 14, the data driver according to the exemplary aspect of the present disclosure may include a shift register SR, a data selector SEL (444/420 Selection Logic), a first latch LAT1 (Sampling), a second latch LAT2 (Sampling), a third latch LAT3 (Holding), a DA converter DAC, an amplifier AMP, etc. The DA converter DAC and the amplifier AMP may be collectively referred to as an output unit.

The shift register SR may function to generate a control signal in order to receive a data signal having a digital form transmitted from a timing controller on a one-line basis.

The data selector SEL may perform an operation of selectively duplicating (expanding) red, green and blue data signals, except for a white data signal, in accordance with a format of a data signal externally input thereto under control of the shift register SR. The data selector SEL may not perform a duplication operation for the data signal input thereto when the data signal has a 4:4:4 format, but may perform a duplication operation for the data signal when the data signal has a 4:2:0 format.

The first latch LAT1 may function to sample a data signal output through the data selector SEL and to store the sampled data signal. The first latch LAT1 may sample red, white, green and blue data signals on a one-line basis. The first latch LAT1 may be referred to as a sampling latch because the first latch LAT1 samples the red, white, green and blue data signals on a one-line basis.

The second latch LAT2 may function to sample a data signal output through the first latch LAT1 and to store the sampled data signal. The second latch LAT2 may sample only the white data signal on a one-line basis. The second latch LAT2 may be referred to as a sampling latch because the second latch LAT2 samples the white data signal on a one-line basis. Under control of the data selector SEL, the second latch LAT2 may take a non-operation state when the data signal has a 4:4:4 format, but may take an operation state when the data signal has a 4:2:0 format, in order to sample only the white data signal. Meanwhile, since the second latch LAT2 samples only the white data signal on a one-line basis, the red, green and blue data signals output through the first latch LAT1 may be input to the third latch LAT3.

The third latch LAT3 may hold the data signals output from the first latch LAT1 and the second latch LAT2 and may output the held data signals. The third latch LAT3 may hold and then output the data signals, corresponding to a source output signal SOE. The third latch LAT3 may be referred to as a holding latch because the third latch LAT3 holds the red, white, green and blue data signals on a one-line basis.

The DA converter DAC may function to convert a data signal having a digital form output from the third latch LAT3 into a data voltage having an analog form, and may then output the data voltage. In addition, the DA converter DAC may convert a data signal having a digital form into a data voltage having an analog form based on a gamma reference voltage output from a gamma unit.

The amplifier AMP may function to amplify data voltages having an analog form converted by the DA converter DAC through respective output channels, and may then output the amplified data voltages. The data voltages output from the amplifier AMP may be applied to subpixels through data lines.

As shown in FIGS. 15 to 17, the data selector SEL may perform the following duplication operation when a data signal externally input thereto is in 4:2:0 format.

The data selector SEL may duplicate a first data signal D1, which is intended to be output through a first data line DL1, as a fifth data signal D5, in order to enable the first data signal D1 to be also output through a fifth data line DL5. The data selector SEL may duplicate a third data signal D3, which is intended to be output through a third data line DL3, as a seventh data signal D7, in order to enable the third data signal D3 to be also output through a seventh data line DL7. The data selector SEL may duplicate a fourth data signal D4, which is intended to be output through a fourth data line DL4, as an eighth data signal D8, in order to enable the fourth data signal D4 to be also output through an eighth data line DL8.

In other words, when the data signal is in 4:2:0 format, the data selector SEL may set a path such that the first data line and the fifth data line are grouped into one group, may set a path such that the third data line and the seventh data line are grouped into one group, and may set a path such that the fourth data line and the eighth data line are grouped into one group. The first to eighth data signals D1 to D8 duplicated by the data selector SEL may be sampled and stored by the first latch LAT1.

Meanwhile, it is noted that the second latch LAT2 disposed at a downstream end of the first latch LAT1 is shown to show that white data signals D2' and D6' previously applied to the second latch LAT2 are separately stored in the second latch LAT2 in accordance with separate sampling operations, respectively. In this case, through a subsequent output procedure, the white data signals D2' and D6' stored in the second latch LAT2 may be output in the form of the eleventh white data voltage W11 and the twelfth white data voltage W12 of FIG. 13, and the white data signals D2 and D6 stored in the first latch LAT1 may be output in the form of the twenty-first white data voltage W21 and the twenty-second white data voltage W22 of FIG. 13.

Data signals shown in FIG. 15 may be held by the third latch LAT3 in the form of odd line data including red, green and blue data signals RGB and even line data including a white data signal W, corresponding to a source output signal SOE (240 Hz) of FIG. 16, and the held data signals may then be output. Thereafter, the data signals output from the third latch LAT3 may be converted into data voltages by the DA converter DAC or the like, and the data voltages may then be output.

Thus, the data driver according to the exemplary aspect of the present disclosure may compensate a data signal for a lost chromaticity component in a digital manner through a duplication operation for a selective data signal of the data selector SEL and a latching operation for a white data signal of the second latch LAT, and may then output the compensated data signal.

As a result, as shown in FIG. 17, the data signal input in 4:2:0 format may be newly configured into a data signal in 4:4:4 format by a compensation operation by the data driver and, as such, a data voltage to be supplied to a display panel may be provided in an expanded state. Accordingly, a picture quality degradation problem may be minimized.

As apparent from the above description, in accordance with the exemplary aspects of the present disclosure, there are effects of not only realizing an image based on a standard type data signal having a 4:4:4 format, but also minimizing a picture quality degradation problem caused by a chromaticity component lost during realization of an image based on a custom type data signal having a 4:2:0 format. In addition, there is an effect of minimizing restrictions such as picture quality degradation, etc. when a data signal compressed in a chroma subsampling manner is implemented in an ultra-high resolution environment of a UHD grade or higher.

The foregoing description and the accompanying drawings have been presented in order to illustratively explain technical ideas of the present disclosure. A person skilled in the art to which the present disclosure pertains can appreciate that diverse modifications and variations acquired by combining, dividing, substituting, or changing constituent elements may be possible without changing essential characteristics of the present disclosure. Therefore, the foregoing aspects disclosed herein shall be interpreted as illustrative only and not as limitative of the principle and scope of the present disclosure. It should be understood that the scope of the present disclosure shall be defined by the appended claims and all of equivalents thereto fall within the scope of the present disclosure.

What is claimed is:

1. A display device comprising:

a display panel configured to display an image;

a gate driver connected to gate lines of the display panel; and a data driver connected to data lines of the display panel, wherein the data driver configured to:

provide duplicates of red, green and blue data signals, except for a white data signal, in a digital data signal having a 4:2:0 format externally input thereto, convert the white data signal, the red, green and blue data signals, and the duplicated red, green and blue data signals, and output an analog data voltage having a 4:4:4 format, wherein the data driver comprises a data selector configured to perform an operation of selectively duplicating the red, green and blue data signals, except for the white data signal, in accordance with a format of a data signal externally input thereto, and wherein the data driver further comprises:

a first latch configured to sample the red, white, green and blue data signals and the duplicated red, green and blue data signals output through the data selector on a one-line basis;

a second latch configured to sample the white data signal output through the first latch on a one-line basis; and a third latch configured to hold the red, green and blue data signal and the duplicated red, green and blue data signals output through the first latch, and the white data signal output through the second latch.

2. The display device according to claim 1, wherein the data selector configured to perform a data signal duplication operation when a digital data signal having a 4:2:0 format is externally input, and does not perform a data signal duplication operation when a digital data signal having a 4:4:4 format is externally input.

3. The display device according to claim 1, wherein the second latch samples only the white data signal under control of the data selector when a digital data signal having a 4:2:0 format is externally input.

4. The display device according to claim 1, wherein the data driver outputs a white data voltage for one horizontal time, and outputs red, green and blue data voltages for two horizontal times.

5. The display device according to claim 4, wherein the red, white, green and blue data voltages are charged in red, white, green and blue subpixels of the display panel during falling edges of gate signals applied to the gate lines, respectively.

6. A display device comprising:

a display panel configured to display an image;

a gate driver connected to gate lines of the display panel; and a data driver connected to data lines of the display panel, wherein the data driver configured to:

provide duplicates of red, green and blue data signals, except for a white data signal, in a digital data signal having a 4:2:0 format externally input thereto, convert the white data signal, the red, green and blue data signals, and the duplicated red, green and blue data signals, and output an analog data voltage having a 4:4:4 format, wherein the display panel comprises:

at least one white subpixel configured to store a white data voltage during a falling edge of a first gate signal applied through a first gate line; and at least one red subpixel, at least one green subpixel and at least one blue subpixel respectively configured to store red, green and blue data voltages during a falling edge of a second gate signal applied through a second gate line disposed next to the first gate line;

wherein the at least one white subpixel, the at least one red subpixel, the at least one green subpixel and the at least one blue subpixel are disposed on a same horizontal line.

7. A data driver comprising:

a data selector configured to perform an operation of selectively duplicating red, green and blue data signals, except for a white data signal, in accordance with a format of a data signal externally input thereto;

a first latch configured to sample the red, white, green and blue data signals and the duplicated red, green and blue data signals output through the data selector on a one-line basis;

a second latch configured to sample the white data signal output through the first latch on a one-line basis;

a third latch configured to hold the red, green and blue data signal and the duplicated red, green and blue data signals output through the first latch, and the white data signal output through the second latch; and an output unit configured to convert the data signals output through the third latch into data voltages having an analog form and to output the data voltages, wherein the output unit outputs an analog data voltage having a 4:4:4 format when the data selector is externally input with a digital data signal having a 4:2:0 format.

8. The data driver according to claim 7, wherein the data selector configured to perform a data signal duplication operation when a digital data signal having a 4:2:0 format is externally input, and does not perform a data signal duplication operation when a digital data signal having a 4:4:4 format is externally input.

* * * * *